US007836711B2

(12) United States Patent
Kojima et al.

(10) Patent No.: US 7,836,711 B2
(45) Date of Patent: Nov. 23, 2010

(54) AIR CONDITIONER HAVING AN ICE MELTING OPERATION TERMINATED ON THE BASIS OF REFRIGERANT TEMPERATURE AND PRESSURE

(75) Inventors: Makoto Kojima, Osaka (JP); Shinichi Kasahara, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 598 days.

(21) Appl. No.: 11/885,059

(22) PCT Filed: Feb. 7, 2006

(86) PCT No.: PCT/JP2006/302072

§ 371 (c)(1),
(2), (4) Date: Aug. 24, 2007

(87) PCT Pub. No.: WO2006/092937

PCT Pub. Date: Sep. 8, 2006

(65) Prior Publication Data

US 2008/0168783 A1 Jul. 17, 2008

(30) Foreign Application Priority Data

Mar. 3, 2005 (JP) ..... 2005-059037

(51) Int. Cl.
*F25D 21/06* (2006.01)
*F25D 21/00* (2006.01)
*F25B 29/00* (2006.01)

(52) U.S. Cl. ..... 62/156; 62/151; 62/155; 62/234; 165/231; 165/232; 165/233

(58) Field of Classification Search ..... 62/80, 62/129, 151, 155, 156, 157, 234; 165/231, 165/232, 233

See application file for complete search history.

(56) References Cited

U.S. PATENT DOCUMENTS 5,870,899 A * 2/1999 Choi ..... 62/155
6,244,057 B1 * 6/2001 Yoshida et al. ..... 62/160

FOREIGN PATENT DOCUMENTS

JP 3-186135 A 8/1991
JP 04-177070 * 6/1992
JP 4-177070 A 6/1992
JP 10-26429 A 1/1998

* cited by examiner

*Primary Examiner*—Frantz F Jules
*Assistant Examiner*—Daniel C Comings
(74) *Attorney, Agent, or Firm*—Birch, Stewart, Kolasch & Birch, LLP

(57) ABSTRACT

Based on a result of detection taken by the high-low pressure difference detection means (93, 97) for detecting a difference between a high and a low pressure of a refrigeration cycle, an estimate of whether there is leakage of refrigerant in an expansion valve (52) is made. Based on the result detected by the high-low pressure difference detection means (93, 97), a control means (81) sets a reference temperature (T3) to a value corresponding to the degree of refrigerant leakage in the expansion valve (52).

5 Claims, 2 Drawing Sheets

AIR CONDITIONER HAVING AN ICE MELTING OPERATION TERMINATED ON THE BASIS OF REFRIGERANT TEMPERATURE AND PRESSURE

TECHNICAL FIELD

The present invention is concerned with air conditioners capable of performing an ice melting operation for melting ice adhering to a utilization-side heat exchanger.

BACKGROUND ART

In an air conditioner which performs indoor space cooling, the evaporative temperature of a utilization-side heat exchanger may fall during a cooling operation in some cases. If the cooling operation is continued in such a state, this causes drain water adhering to the surface of the utilization-side heat exchanger to freeze to ice. The adhesion of ice to the surface of the utilization-side heat exchanger inhibits heat exchange between refrigerant and air in the utilization-side heat exchanger. To cope with this problem, air conditioners which perform such a cooling operation are so configured as to execute an ice melting operation for melting adhered ice. In the ice melting operation, the expansion valve is closed to stop inflow of refrigerant and air is fed to the utilization-side heat exchanger to thereby melt ice adhering thereto. This type of air conditioner is disclosed, for example, in JP-A-H03-186135 and JP-A-H10-26429.

More specifically, referring to FIG. 2 of JP-A-H03-186135, there is shown an air conditioner in which three indoor units are provided with respect to a single outdoor unit. Each indoor unit has a respective liquid temperature sensor for measuring the temperature of liquid refrigerant in an associated indoor-side heat exchanger. The air conditioner includes a control unit. The control unit is so configured as to terminate the ice melting operation upon elapse of a reference time since the value of measurement taken by the liquid temperature sensor exceeded a reference temperature.

In addition, referring to FIG. 1 of JP-A-H10-26429, there is shown an air conditioner in which two indoor units are provided with respect to a single outdoor unit. In an indoor-side heat exchanger of each indoor unit, a heat exchange temperature sensor is provided as a means for detecting whether there is leakage of refrigerant from an expansion valve. In the air conditioner, it is configured such that, in the event of detection of refrigerant leakage during the ice melting operation, a recovery operation is carried out whereby the expansion valve is repeatedly alternately fully opened/closed in order to eliminate the refrigerant leakage.

DISCLOSURE OF THE INVENTION

Problems which the Invention Seeks to Overcome

Incidentally, if, as in the conventional technique, it is arranged such that the ice melting operation is brought into a halt after the value of measurement taken by a temperature sensor disposed in a utilization-side heat exchanger or the like exceeds a reference temperature, this may cause, in the event of occurrence of refrigerant leakage in the expansion valve, the problem that the ice melting operation fails to terminate thereby preventing the air conditioner from returning to its normal cooling operation. In other words, if the ice melting operation is carried out with refrigerant leaking from the expansion valve, this causes refrigerant of low temperature to flow into the utilization-side heat exchanger. As a result, the value of measurement taken by the temperature sensor disposed in the utilization-side heat exchanger will not increase up to the reference temperature. Consequently, although ice adhering to the utilization-side heat exchanger has been already melted, the air conditioner will not return to the normal cooling operation, in other words, the ice melting operation is continued. This may lessen the comfort of the user.

There is a technique for solving the above problem, such as one disclosed in JP-A-H10-26429. That is, refrigerant leakage from the expansion valve is eliminated by the aforesaid recovery operation. However, in the case where the expansion valve suffers deterioration, refrigerant leakage from the expansion valve is not eliminated even by the recovery operation. In addition, there is the case where the recovery operation may be unable to immediately eliminate refrigerant leakage. In such a case, it becomes impossible to accurately determine termination of the ice melting operation. Accordingly, although the air conditioner is configured such that it performs a recovery operation, the ice melting operation is continuously carried out even after the adhered ice has been melted. This may lessen the comfort of the user.

With the above problems in mind, the present invention was devised. Accordingly, a general object of the present invention is to provide an air conditioner capable of accurately determining termination of an ice melting operation, regardless of whether or not there is refrigerant leakage in an expansion valve.

Means for Overcoming the Problems

The present invention provides, as a first aspect, an air conditioner which comprises a refrigerant circuit (20) wherein the refrigerant circuit (20) includes: a compressor (41); a utilization-side heat exchanger (53); and an expansion valve (52) for controlling the amount of refrigerant flowing into the utilization-side heat exchanger (53), to thereby perform a refrigeration cycle, and wherein the air conditioner performs a cooling operation for room cooling while during the cooling operation the air conditioner is able to execute an ice melting operation for melting of ice adhering to the utilization-side heat exchanger (53) by closing the expansion valve (52) to thereby feed air to the utilization-side heat exchanger (53). The air conditioner of the first aspect comprises: a high-low pressure difference detection means (93, 97) for detecting a difference between a high and a low pressure of the refrigeration cycle; a temperature measurement means (54) for measuring either the temperature of a pipe line between the expansion valve (52) and the utilization-side heat exchanger (53) or the temperature of the utilization-side heat exchanger (53); and a control means (81) for activating the ice melting operation to start if a predetermined start condition is met and for terminating the ice melting operation if the value of measurement taken by the temperature measurement means (54) continuously remains equal to or above a reference temperature (T3) for a reference time (t3), wherein, based on the value of measurement taken by the high-low pressure difference detection means (93, 97), the control means (81) sets the reference temperature (T3).

The present invention provides, as a second aspect according to the aforesaid first aspect, an air conditioner wherein the air conditioner further comprises a room temperature measurement means (56) for measuring room temperature, and wherein the control means (81) decides, based on a difference between the value of measurement taken by the temperature measurement means (54) and the value of measurement taken by the room temperature measurement means (56) during suspension of the cooling operation, a correction value, and corrects, by use of the correction value, the reference temperature (T3) set based on the value of measurement taken by the high-low pressure difference detection means (93, 97).

The present invention provides, as a third aspect, an air conditioner which comprises a refrigerant circuit (20) wherein the refrigerant circuit (20) includes: a compressor (41); a utilization-side heat exchanger (53); and an expansion valve (52) for controlling the amount of refrigerant flowing into the utilization-side heat exchanger (53), to thereby perform a refrigeration cycle, and wherein the air conditioner performs a cooling operation for room cooling while during the cooling operation the air conditioner is able to execute an ice melting operation for melting of ice adhering to the utilization-side heat exchanger (53) by closing the expansion valve (52) to thereby feed air to the utilization-side heat exchanger (53). The air conditioner of the third embodiment comprises: a temperature measurement means (54) for measuring either the temperature of a pipe line between the expansion valve (52) and the utilization-side heat exchanger (53) or the temperature of the utilization-side heat exchanger (53); a room temperature measurement means (56) for measuring room temperature; and a control means (81) for activating the ice melting operation to start if a predetermined start condition is met and for terminating the ice melting operation if the value of measurement taken by the temperature measurement means (54) continuously remains equal to or above a reference temperature (T3) for a reference time (t3), wherein, based on a difference between the value of measurement taken by the temperature measurement means (54) and the value of measurement taken by the room temperature measurement means (56) during suspension of the cooling operation, the control means (81) sets the reference temperature (T3).

The present invention provides, as a fourth aspect according to any one of the aforesaid first to third aspects, an air conditioner wherein, based on a difference between the value of measurement taken by the temperature measurement means (54) and the value of measurement taken by the room temperature measurement means (56), the control means (81) sets the reference time (t3).

The present invention provides, as a fifth aspect, an air conditioner which comprises a refrigerant circuit (20) wherein the refrigerant circuit (20) includes: a compressor (41); a utilization-side heat exchanger (53); and an expansion valve (52) for controlling the amount of refrigerant flowing into the utilization-side heat exchanger (53), to thereby perform a refrigeration cycle, and wherein the air conditioner performs a cooling operation for room cooling while during the cooling operation the air conditioner is able to execute an ice melting operation for melting of ice adhering to the utilization-side heat exchanger (53) by closing the expansion valve (52) to thereby feed air to the utilization-side heat exchanger (53). The air conditioner of the fifth aspects comprises: a temperature measurement means (54) for measuring either the temperature of a pipe line between the expansion valve (52) and the utilization-side heat exchanger (53) or the temperature of the utilization-side heat exchanger (53); a room temperature measurement means (56) for measuring room temperature; and a control means (81) for activating the ice melting operation to start if a predetermined start condition is met and for terminating the ice melting operation if the value of accumulation of differences between the value of measurement taken by the temperature measurement means (54) and the value of measurement taken by the room temperature measurement means (56) since the time when the ice melting operation was started exceeds a predetermined preset value.

The present invention provides, as a sixth aspect according to any one of the aforesaid first to fifth aspects, an air conditioner wherein the control means (81) terminates the ice meting operation if the duration time of the ice melting operation reaches a predetermined upper limit time (t4) and sets, based on a difference between the value of measurement taken by the temperature measurement means (54) and the value of measurement taken by the room temperature measurement means (56), the upper limit time (t4).

The present invention provides, as a seventh aspect, an air conditioner comprising a refrigerant circuit (20) wherein the refrigerant circuit (20) includes: a compressor (41); a utilization-side heat exchanger (53); and an expansion valve (52) for controlling the amount of refrigerant flowing into the utilization-side heat exchanger (53), to thereby perform a refrigeration cycle, and wherein the air conditioner performs a cooling operation for room cooling while during the cooling operation the air conditioner is able to execute an ice melting operation for melting of ice adhering to the utilization-side heat exchanger (53) by closing the expansion valve (52) to thereby feed air to the utilization-side heat exchanger (53). The air conditioner of the seventh aspect comprises: a temperature measurement means (54) for measuring either the temperature of a pipe line between the expansion valve (52) and the utilization-side heat exchanger (53) or the temperature of the utilization-side heat exchanger (53); a room temperature measurement means (56) for measuring room temperature; and a control means (81) for activating the ice melting operation to start if a predetermined start condition is met and for terminating the ice melting operation if the duration time of the ice melting operation reaches a predetermined operating time (t5), wherein, based on a difference between the value of measurement taken by the temperature measurement means (54) and the value of measurement taken by the room temperature measurement means (56), the control means (81) sets the operating time (t5).

The present invention provides, as an eighth aspect according to any one of the aforesaid first to seventh aspects, an air conditioner wherein the refrigerant circuit (20) includes a plurality of the utilization-side heat exchangers (53) and a plurality of the expansion valves (52) each of which controls the amount of refrigerant flowing into its associated utilization-side heat exchanger (53), wherein the ice melting operation is executable for each of the utilization-side heat exchangers (53), and wherein the control means (81) controls start and termination of the ice melting operation for each of the utilization-side heat exchangers (53).

Operation

It is configured in the first aspect of the present invention such that, if the value of measurement taken by the temperature measurement means (54) continuously remains equal to or above the reference temperature (T3) for the reference time (t3) since the time when the ice melting operation was started, the control means (81) brings the ice melting operation to a halt. Based on a result of detection taken by the high-low pressure difference detection means (93, 97), the control means (81) sets the reference temperature (T3). The difference between high and low pressures of the refrigeration cycle which is detected by the high-low pressure difference detection means (93, 97) approximately equals the refrigerant pressure difference across the expansion valve (52). As the high-low pressure difference of the refrigerant cycle increases, the refrigerant pressure across the expansion valve (52) likewise increases, and refrigerant leakage tends to occur in the expansion valve (52). Consequently, the degree of refrigerant leakage in the expansion valve (52) is estimated from the high-low pressure difference of the refrigerant cycle detected by the high-low pressure difference detection means (93, 97). Therefore, in the first aspect of the present invention, based on a result of detection taken by the high-low pressure difference detection means (93, 97), the reference temperature (T3) is set to a value corresponding to the degree of refrigerant leakage in the expansion valve (52).

In the second aspect of the present invention, based on a difference between the value of measurement taken by the temperature measurement means (54) and the value of measurement taken by the room temperature measurement means (56) during suspension of the cooling operation, the control means (81) decides a correction value. In the control means (81), the thus decided correction value is used to correct the reference temperature (T3) set based on the value of measurement taken by the high-low pressure difference detection means (93, 97). Once the cooling operation is brought into a halt, the expansion valve (52) is placed in the closed state. If, in this state, there is no refrigerant leakage from the expansion valve (52), the value of measurement taken by the temperature measurement means (54) approaches the value of measurement taken by the room temperature measurement means (56) as time passes since the time when the cooling operation was terminated. On the other hand, in the event of occurrence of refrigerant leakage from the expansion valve (52), the point (the temperature of which is measured by the temperature measurement means (54)) is cooled by leaked refrigerant. As a result, the value of measurement taken by the temperature measurement means (54) will not increase so much (as compared to the case where no refrigerant leaks). To sum up, the degree of degradation of the expansion valve (52) is estimated by grasping the degree of refrigerant leakage in the expansion valve (52). Therefore, in the second aspect of the present invention, based on a difference between the value of measurement taken by the temperature measurement means (54) and the value of measurement taken by the room temperature measurement means (56) during suspension of the cooling operation, the control means (81) decides a correction value corresponding to the degree of degradation of the expansion valve (52). The thus decided correction value is used to correct the reference temperature (T3) set based on the value of measurement taken by the high-low pressure difference detection means (93, 97).

In the third aspect of the present invention, based on a difference between the value of measurement taken by the temperature measurement means (54) and the value of measurement taken by the room temperature measurement means (56) during suspension of the cooling operation, the control means (81) sets the reference temperature (T3). As explained in the second aspect of the present invention, the degree of degradation of the expansion valve (52) is estimated from a difference between the value of measurement taken by the temperature measurement means (54) and the value of measurement taken by the room temperature measurement means (56) during suspension of the cooling operation. Therefore, in the third aspect of the present invention, based on the measured value difference, the reference temperature (T3) is set to a value corresponding to the degree of degradation of the expansion valve (52).

In the fourth aspect of the present invention, based on a difference between the value of measurement taken by the temperature measurement means (54) and the value of measurement taken by the room temperature measurement means (56), the control means (81) sets the reference time (t3). The measured value difference is indicative of a difference in temperature between air which is fed to the utilization-side heat exchanger (53) and the measurement point of the temperature measurement means (54). As such a temperature difference increases, the amount of heat exchanged (per unit time) between air fed to the utilization-side heat exchanger (53) and ice adhering to the utilization-side heat exchanger (53) increases. Therefore, the ice adhering to the utilization-side heat exchanger (53) tends to easily melt, and is melted for a short period of time. Consequently, the degree of meltability of the adhered ice (the degree of how easily the adhered ice is melted) is estimated from a difference between the value of measurement taken by the temperature measurement means (54) and the value of measurement taken by the room temperature measurement means (56). Therefore, in the fourth aspect of the present invention, based on the measured value difference, the reference time (t3) is set to a value corresponding to the degree of meltability of the adhered ice.

In the fifth aspect of the present invention, the control means (81) accumulates differences between the value of measurement taken by the temperature measurement means (54) and the value of measurement taken by the room temperature measurement means (56) since the time when the ice melting operation was started. The amount of heat exchanged (per unit time) between air which is fed to the utilization-side heat exchanger (53) and ice adhering to the utilization-side heat exchanger (53) is approximately proportional to the difference between the value of measurement taken by the temperature measurement means (54) and the value of measurement taken by the room temperature measurement means (56). Consequently, the amount of heat exchanged between air which is fed to the utilization-side heat exchanger (53) and ice adhering to the utilization-side heat exchanger (53) during the ice melting operation is estimated from the value of accumulation of differences between the value of measurement taken by the temperature measurement means (54) and the value of measurement taken by the room temperature measurement means (56). Therefore, it is configured in the fifth aspect of the present invention such that the value which is obtained as a result of the aforesaid accumulation and from which an estimate of the amount of exchanged heat can be derived is used to determine termination of the ice melting operation.

In the sixth aspect of the invention, the upper limit time (t4) is set in order that the ice melting operation may be forcibly brought into a halt. Based on a difference between the value of measurement taken by the temperature measurement means (54) and the value of measurement taken by the room temperature measurement means (56), the control means (81) sets the upper limit time (t4). As explained in the fourth aspect of the present invention, the degree of meltability of the adhered ice is estimated from a difference between the value of measurement taken by the temperature measurement means (54) and the value of measurement taken by the room temperature measurement means (56). Therefore, in the sixth aspect of the present invention, based on the measured value difference, the upper limit time (t4) is set to a value corresponding to the degree of meltability of the adhered ice.

In the seventh aspect of the present invention, based on a difference between the value of measurement taken by the temperature measurement means (54) and the value of measurement taken by the room temperature measurement means (56), the control means (81) sets the operating time (t5) from start to termination of the ice melting operation. As explained in the fourth aspect of the present invention, the degree of meltability of the adhered ice is estimated from a difference between the value of measurement taken by the temperature measurement means (54) and the value of measurement taken by the room temperature measurement means (56). Therefore, in the seventh aspect of the present invention, based on the measured value difference, the operating time (t5) is set to a value corresponding to the degree of meltability of the adhered ice.

In the eighth aspect of the present invention, the control means (81) performs individual ice melting operation control on each of the plural utilization-side heat exchangers (53) disposed in the refrigerant circuit (20). The ice melting operation is executable for each of the utilization-side heat exchangers (53). In the eighth aspect of the present invention, when the control means (81) determines execution of an ice melting operation to a specific one of the utilization-side heat exchangers (53), only the specific one of the utilization-side heat exchangers (53) is subjected to the ice melting operation.

Advantageous Effects of the Invention

It is configured in each of the first, second, fourth, sixth, and eighth aspects of the present invention such that the degree of refrigerant leakage in the expansion valve (52) is estimated from a result of detection taken by the high-low pressure difference detection means (93, 97). Therefore, based on a result of detection taken by the high-low pressure difference detection means (93, 97), the control means (81) sets the reference temperature (T3) (which serves as a threshold for determining termination of the ice melting operation) to a value corresponding to the degree of refrigerant leakage in the expansion valve (52). In the past, the reference temperature (T3) has been decided without taking into consideration the leakage of refrigerant in the expansion valve (52). In the present invention, however, the reference temperature (T3) is set to a value corresponding to the degree of refrigerant leakage in the expansion valve (52), whereby, even in the event of occurrence of refrigerant leakage from the expansion valve (52), it is possible to determine termination of the ice melting operation at the reference temperature (T3) corresponding to the refrigerant leakage. Accordingly, it becomes possible to accurately determine termination of the ice melting operation, regardless of the presence or absence of refrigerant leakage in the expansion valve (52). This therefore makes it possible to prevent the ice melting operation from being unnecessarily executed while also preventing some ice from remaining unmelted.

Additionally, it is configured in the second aspect of the present invention such that an estimate of the degree of degradation of the expansion valve (52) is derived from a difference between the value of measurement taken by the temperature measurement means (54) and the value of measurement taken by the room temperature measurement means (56) during suspension of the cooling operation. Therefore, the control means (81) corrects, by use of a correction value corresponding to the degree of degradation of the expansion valve (52), the reference temperature (T3) set based on the value of measurement taken by the high-low pressure difference detection means (93, 97). The degree of degradation of the expansion valve (52) has an effect on the degree of refrigerant leakage in the expansion valve (52) during the ice melting operation, like when the cooling operation is under suspension. The second aspect of the present invention uses a correction value corresponding to the degree of degradation of the expansion valve (52) to correct the reference temperature (T3), and the reference temperature (T3) comes to have a value that reflects the degree of degradation of the expansion valve (52). Accordingly, it becomes possible to more accurately determine termination of the ice melting operation.

In addition, it is configured in the third aspect of the present invention such that an estimate of the degree of degradation of the expansion valve (52) is derived from a difference between the value of measurement taken by the temperature measurement means (54) and the value of measurement taken by the room temperature measurement means (56). Therefore, based on the measured value difference, the control means (81) sets the reference temperature (T3) serving as a threshold for determining termination of the ice melting operation to a value corresponding to the degree of degradation of the expansion valve (52). The expansion valve (52) is liable to undergo leakage of refrigerant therefrom when degraded. In the third aspect of the present invention, however, the reference temperature (T3) is set to a value corresponding to the degree of degradation of the expansion valve (52), whereby, even in the case where there is leakage of refrigerant due to degradation of the expansion valve (52), it is possible to determine termination of the ice melting operation at the reference temperature (T3) corresponding to that valve degradation. Accordingly, even in the case where there is leakage of refrigerant due to degradation of the expansion valve (52), it is possible to accurately determine termination of the ice melting operation. This therefore makes it possible to prevent the ice melting operation from being unnecessarily executed while also preventing some ice from remaining unmelted.

In addition, it is configured in the fourth aspect of the present invention such that an estimate of the degree of meltability of ice adhering to the utilization-side heat exchanger (53) is derived from a difference between the value of measurement taken by the temperature measurement means (54) and the value of measurement taken by the room temperature measurement means (56). Therefore, based on the measured value difference, the control means (81) sets the reference time (t3) to a value corresponding to the estimated degree of meltability. In the past, the ice melting operation has been brought to a halt according to the fixed reference time (t3), regardless of the degree of meltability of the adhered ice. In the fourth aspect of the present invention, however, the reference time (t3) is set to a value corresponding to the degree of meltability of the adhered ice, because the time required for melting of the adhered ice varies depending on the degree of meltability of the adhered ice. This therefore makes it possible to more accurately determine termination of the ice melting operation.

Additionally, it is configured in the fifth aspect of the present invention such that the value of accumulation of differences between the value of measurement taken by the temperature measurement means (54) and the value of measurement taken by the room temperature measurement means (56), which permits an estimate of the amount of heat exchanged between air fed into the utilization-side heat exchanger (53) and ice adhering to the utilization-side heat exchanger (53) during execution of the ice melting operation, is used to determine termination of the ice melting operation. The amount of heat exchange estimated from the accumulation value corresponds to the amount of melted ice. This therefore makes it possible to estimate, from the accumulation value, whether or not a predetermined amount of ice has been melted, whereby it becomes possible to accurately determine termination of the ice melting operation. In addition, it is configured in the fifth aspect of the present invention such that, even in the case where there is leakage of refrigerant, the increase in the value of accumulation of differences between the value of measurement taken by the temperature measurement means (54) and the value of measurement taken by the room temperature measurement means (56) will not be impeded. This therefore eliminates the problem associated with the conventional technology that the air conditioner fails to return to its normal cooling operation from the ice melting operation due to refrigerant leakage in the expansion valve (52). Consequently, it becomes possible to prevent the ice melting operation from being unnecessarily executed while also preventing some ice from remaining unmelted.

In addition, it is configured in the sixth aspect of the present invention such that an estimate of the degree of meltability of ice adhering to the utilization-side heat exchanger (53) is derived from a difference between the value of measurement taken by the temperature measurement means (54) and the value of measurement taken by the room temperature measurement means (56). Therefore, based on the measured value difference, the control means (81) sets the upper limit time (t4) to a value corresponding to the estimated degree of meltability. The control means (81) determines termination of the ice melting operation, not only from the condition that the value of measurement taken by the temperature measurement means (54) continuously remains equal to or above the reference temperature (T3) for the reference time (t3) but also from the upper limit time (t4) which is set to a value corresponding to the estimated degree of meltability. This therefore makes it possible to more accurately determine termination of the ice melting operation.

In addition, it is configured in the seventh aspect of the present invention such that an estimate of the degree of meltability of ice adhering to the utilization-side heat exchanger (53) is derived from a difference between the value of measurement taken by the temperature measurement means (54) and the value of measurement taken by the room temperature measurement means (56). Therefore, based on the measured value difference, the control means (81) sets the operating time (t5) from start to termination of the ice melting operation to a value corresponding to the estimated degree of meltability. The time required for melting of the adhered ice varies depending on the degree of meltability thereof. In the seventh aspect of the present invention, the operating time (t5) is set to a value corresponding to the estimated degree of meltability of the adhered ice, which setting makes it possible to more accurately determine termination of the ice melting operation. Additionally, even if there is leakage of refrigerant from the expansion valve (52), this has little effect on the setting of the operating time (t5). Consequently, the problem associated with the conventional technology that the air conditioner fails to return to its normal cooling operation from the ice melting operation due to refrigerant leakage in the expansion valve (52) is avoided. This therefore makes it possible to prevent the ice melting operation from being unnecessarily executed while also preventing some ice from remaining unmelted.

In addition, it is configured in the eighth aspect of the present invention such that the control means (81) individually performs ice melting operation control on each of the plural utilization-side heat exchangers (53) disposed in the refrigerant circuit (20), and that, when the control means (81) decides execution of the ice melting operation on a certain one of the plural utilization-side heat exchangers (53), only the certain one utilization-side heat exchanger (53) is subjected to the ice melting operation. In other words, even when the ice melting operation is being executed in a certain one of the plural utilization-side heat exchangers (53), it is possible to perform a normal cooling operation in another utilization-side heat exchanger (53). Accordingly, in the air conditioner (10) of the eighth aspect of the present invention, the indoor spaces in which the utilization-side heat exchangers (53) are disposed respectively are properly cooled.

REFERENCE NUMERALS IN THE DRAWINGS

10: air conditioner
20: refrigerant circuit
41*a*: variable capacity compressor (compressor)
41*b*: fixed capacity compressor (compressor)
52: expansion valve
53: indoor heat exchanger (utilization-side heat exchanger)
54: first temperature sensor (temperature detection means)
56: room temperature sensor (room temperature measurement means)
81: ice melting operation control part (control means)
93: suction pressure sensor (high-low pressure difference detection means)
97: discharge pressure sensor (high-low pressure difference detection means)

BEST EMBODIMENT MODE FOR CARRYING OUT THE INVENTION

In the following, preferred embodiments of the present invention will be described in detail with reference to the accompanying drawings.

First Embodiment of the Invention

A first embodiment of the present invention provides an air conditioner (10). The air conditioner (10) is configured as a multi-type air conditioner for installation in a building or the like, and performs temperature control in a plurality of indoor spaces of the building.

Figure 1:
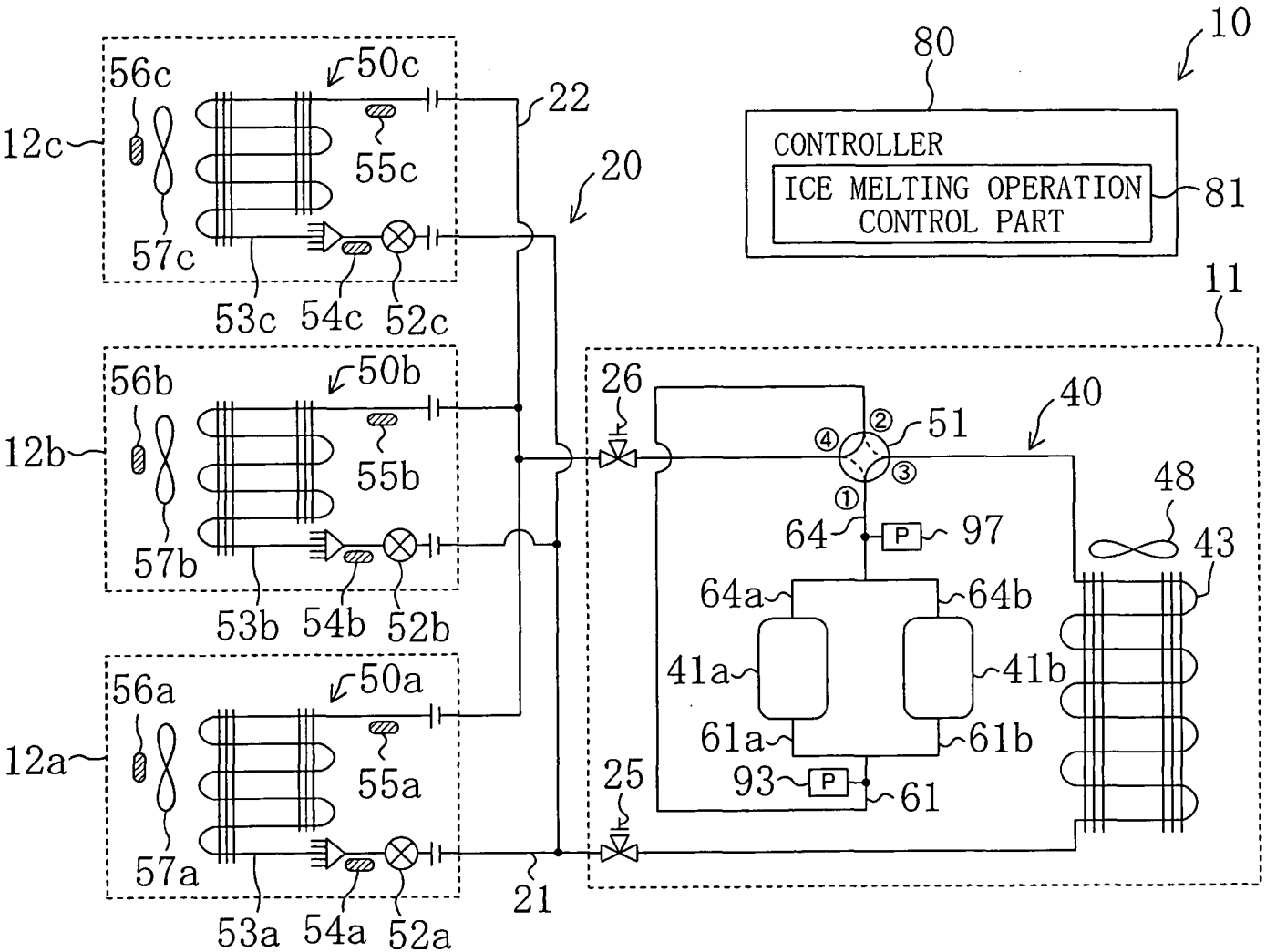
FIG. 1 is a schematic block diagram of an air conditioner according to a first embodiment of the present invention.

Referring to FIG. 1, the air conditioner (10) of the first embodiment is provided with a single outdoor unit (11) and three indoor units (12*a*, 12*b*, 12*c*). Note here that the number of indoor units (12) in the first embodiment is three, which is, however, for illustrative purposes only, in other words, two or equal to or more than four indoor units (12) may be employed. The outdoor unit (11) is installed outside the building while on the other hand the three indoor units (12*a*, 12*b*, 12*c*) are installed respectively in different indoor spaces.

The outdoor unit (11) has an outdoor circuit (40). Each indoor unit (12) is provided with a respective indoor circuit (50). In the air conditioner (10), these circuits (40, 50*a*, 50*b*, 50*c*) are connected together by refrigerant piping to form a refrigerant circuit (20). The outdoor circuit (40) constitutes a heat source-side circuit. Each indoor circuit (50) constitutes a respective utilization-side circuit.

Each indoor circuit (50) is connected mutually in parallel with the outdoor circuit (40). More specifically, each indoor circuit (50) is connected through a liquid-side interconnecting pipe line (21) and through a gas-side interconnecting pile line (22) to the outdoor unit (40). One end of the liquid-side interconnecting pipe line (21) is connected to a liquid-side closing valve (25) of the outdoor circuit (40). The other end of the liquid-side interconnecting pipe line (21) is branched off into three branch pipe lines which are connected to liquid-side ends of the indoor circuits (50), respectively. One end of the gas-side interconnecting pipe line (22) is connected to a gas-side closing valve (26) of the outdoor circuit (40). The other end of the gas-side interconnecting pipe line (22) is branched off into three branch pipe lines which are connected to gas-side ends of the indoor circuits (50), respectively.

Outdoor Unit

As described above, the outdoor unit (11) is provided with the outdoor circuit (40). The outdoor circuit (40) includes a variable capacity compressor (41*a*), a fixed capacity compressor (41*b*), an outdoor heat exchanger (43), and a four-way switching valve (51). Both the variable capacity compressor (41*a*) and the fixed capacity compressor (41*b*) are hermetical scroll compressors and are of the so-called high-pressure dome type. The variable capacity compressor (41*a*) is supplied with electrical power through an inverter. The variable capacity compressor (41) is made variable in capacity by varying the output frequency of the inverter to thereby change the rotational speed of a compressor motor. The variable capacity compressor (41*a*) constitutes a main compressor. On the other hand, the fixed capacity compressor (41*b*) is operated by a compressor motor whose rotational speed is constant, in other words, the capacity of the fixed capacity compressor (41*b*) is unchangeable.

A discharge pipe (64) is in connection with the variable capacity compressor (41*a*) and the fixed capacity compressor (41*b*). One end of the discharge pipe (64) is connected to a first port of the four-way switching valve (51). The discharge pipe (64) is, on the side of the other end thereof, branched off into a first discharge pipe (64*a*) and a second discharge pipe (64*b*). The first discharge pipe (64*a*) is connected to the discharge side of the variable capacity compressor (41*a*) and the second discharge pipe (64*b*) is connected to the discharge side of the fixed capacity compressor (41*b*).

The variable capacity compressor (41*a*) and the fixed capacity compressor (41*b*) are connected, at their respective suction ends, to a suction pipe (61). One end of the suction pipe (61) is connected to a second port of the four-way switching valve (51). The suction pipe (61) is, on the side of the other end thereof, branched off into a first suction pipe (61*a*) and a second suction pipe (61*b*). The first suction pipe (61*a*) is connected to the suction side of the variable capacity compressor (41*a*) and the second suction pipe (61*b*) is connected to the suction side of the fixed capacity compressor (41*b*).

The outdoor heat exchanger (43) is a fin and tube heat exchanger of the cross fin type, and constitutes a heat source-side heat exchanger. One end of the outdoor heat exchanger (43) is connected to a third port of the four-way switching valve (51). On the other hand, the other end the outdoor heat exchanger (43) is connected to the liquid-side closing valve (25). In addition, the outdoor unit (11) is provided with an outdoor fan (48). The outdoor heat exchanger (43) is supplied with outdoor air by the outdoor fan (48).

As described above, the first to fourth ports of the four-way switching valve (51) are connected, respectively, to the discharge pipe (64), the suction pipe (61), the outdoor heat exchanger (43), and the gas-side closing valve (26). The four-way switching valve (51) is switchable between a first state (represented by solid line in FIG. 1) and a second state (represented by broken line in FIG. 1). When placed in the first state, the four-way switching valve (51) establishes fluid communication between the first and third ports as well as between the second and fourth ports, while when placed in the second state it establishes fluid communication between the first and fourth ports as well as between the second and third ports.

In the outdoor circuit (40), the suction pipe (61) is provided with a suction pressure sensor (93) and the discharge pipe (64) is provided with a discharge pressure sensor (97). The suction pressure sensor (93) measures the pressure of low pressure-side refrigerant flowing through the suction pipe (61). On the other hand, the discharge pressure sensor (97) measures the pressure of high pressure-side refrigerant flowing through the discharge pipe (64). The difference between high and low pressures of a refrigeration cycle which is performed in the refrigerant circuit (20) is detected from a difference between the value of measurement taken by the suction pressure sensor (93) and the value of measurement taken by the discharge pressure sensor (97). That is, the suction pressure sensor (93) and the discharge pressure sensor (97) together constitute a high-low pressure difference detection means of the present invention. Both the value of measurement taken by the suction pressure sensor (93) and the value of measurement taken by the discharge pressure sensor (97) are fed to an ice melting operation control part (81) of a controller (80) (described later).

Indoor Unit

As described above, the indoor circuit (50) is provided in each indoor unit (12). In each indoor circuit (50), an expansion valve (52) and an indoor heat exchanger (53) are disposed in order from the liquid-side to the gas-side end thereof. The indoor heat exchanger (53) is a fin and tube heat exchanger of the cross fin type and constitutes a utilization-side heat exchanger. The expansion valve (52) is formed by an electronic expansion valve. In addition, the indoor unit (12) is provided with an indoor fan (57). The indoor heat exchanger (53) is supplied with room air by the indoor fan (57).

In the indoor circuit (50), a refrigerant pipe line for connection between the expansion valve (52) and the indoor heat exchanger (53) is provided with a first temperature sensor (54) for measuring the temperature of the refrigerant pipe line. The first temperature sensor (54) constitutes a temperature detection means of the present invention. The first temperature sensor (54) may be disposed in the indoor heat exchanger (53) for measuring the temperature thereof. In addition, a refrigerant pipe line for connection between the indoor heat exchanger (53) and the gas-side end of the indoor circuit (50) is provided with a second temperature sensor (55). Furthermore, the indoor unit (12) is provided with a room temperature sensor (56) for measuring the temperature of an indoor space in which the indoor unit (12) is installed. The room temperature sensor (56) constitutes a room temperature detection means of the present invention. The value of measurement taken by the first temperature sensor (54), the value of measurement taken by the second temperature sensor (55), and the value of measurement taken by the room temperature sensor (56) are all fed to the ice melting operation control part (81) of the controller (80) (described later).

Configuration of the Controller

The air conditioner (10) of the first embodiment includes the controller (80) for controlling both the compressors (41*a*, 41*b*) and for adjusting, for example, the degree of valve opening of the expansion valve (52), in response to an operating condition of the air conditioner (10). The controller (80) has the ice melting operation control part (81) for performing control operations relating to the after-mentioned ice melting operation. The ice melting operation control part (81) constitutes a control means of the present invention. The ice melting operation control part (81) determines start or termination of the ice melting operation, with respect to each of the indoor heat exchangers (53). Details of the operation of the controller (80) will be described later.

Although the air conditioner (10) of the first embodiment is configured as a multi-type air conditioner in which a plurality of indoor units (12, . . . ) are provided with respect to a single outdoor unit (11). Alternatively, the air conditioner (10) of the first embodiment may be configured as an air conditioner having a single outdoor unit (11) and a single indoor unit (12).

Running Operation

The air conditioner (10) performs a cooling operation and a heating operation. In addition to these operations, the air conditioner (10) is configured to perform an ice melting operation during the cooling operation if required.

Cooling Operation

In the first place, the cooling operation is described. In the cooling operation, the four-way switching valve (23) is placed in the first state (represented by solid line in FIG. 1) and the variable capacity compressor (41*a*) and the fixed capacity compressor (41*b*) are operated. The degree of valve opening of the expansion valve (52) of each indoor unit (12) is individually controlled depending on the cooling load of each indoor space to thereby set the flow rate of refrigerant. In addition, the volume of air is also controlled individually in each indoor unit (12).

Refrigerant discharged out of the variable capacity compressor (41*a*) and the fixed capacity compressor (41*b*) flows through the discharge pipe (64) and then through the four-way switching valve (51) into the outdoor heat exchanger (43). In the outdoor heat exchanger (43), the refrigerant gives up heat to outdoor air and is condensed. The refrigerant condensed in the outdoor heat exchanger (43) flows and passes through the liquid-side interconnecting pipe line (21) and is distributed to each indoor circuit (50).

Refrigerant having flowed into the indoor circuit (50) is reduced in pressure during passage through the expansion valve (52) and then introduced into the indoor heat exchanger (53). In the indoor heat exchanger (53), the refrigerant extracts heat from indoor air and is evaporated. Indoor air cooled in the indoor heat exchanger (53) is supplied into the room. The refrigerant evaporated in the indoor heat exchanger (53) flows through the gas-side interconnecting pipe line (22) into the outdoor circuit (40). The refrigerant having flowed into the outdoor circuit (40) is, after passage through the four-way switching valve (51), drawn through the suction pipe (61) into the variable capacity compressor (41*a*) and the fixed capacity compressor (41*b*). The refrigerant drawn into the variable capacity compressor (41*a*) and the fixed capacity compressor (41*b*) is again compressed and then discharged to the discharge pipe (64).

Heating Operation

Subsequently, the heating operation is described. In the heating operation, the four-way switching valve (23) is placed in the second state (represented by broken line in FIG. 1) and the variable capacity compressor (41*a*) and the fixed capacity compressor (41*b*) are operated. The degree of valve opening of the expansion valve (52) of each indoor unit (12) is individually controlled depending on the heating load of each indoor space to thereby set the flow rate of refrigerant. In addition, the volume of air is also controlled individually in each indoor unit (12).

Refrigerant discharged out of the variable capacity compressor (41*a*) and the fixed capacity compressor (41*b*) passes through the discharge pipe (64), then through the four-way switching valve (51), and then through the gas-side interconnecting pipe line (22). Then, the refrigerant is distributed to each indoor circuit (50). The refrigerant having flowed into the indoor circuit (50) is introduced into the indoor heat exchanger (53). In the indoor heat exchanger (53), the refrigerant gives up heat to indoor air and is condensed. Indoor air heated in the indoor heat exchanger (53) is supplied into the room.

The refrigerant condensed in the indoor heat exchanger (53) flows through the expansion valve (52) and then through the liquid-side interconnecting pipe line (21) into the outdoor heat exchanger (43). In the outdoor heat exchanger (43), the refrigerant extracts heat from outdoor air and is evaporated. The refrigerant evaporated in the outdoor heat exchanger (43) passes through the four-way switching valve (51) and then through the suction pipe (61) and is drawn into the variable capacity compressor (41*a*) and the fixed capacity compressor (41*b*). The refrigerant drawn into the variable capacity compressor (41*a*) and the fixed capacity compressor (41*b*) is again compressed and then discharged to the discharge pipe (64).

Ice Melting Operation

As mentioned above, during the cooling operation, an ice melting operation is carried out if required. For the case of the multi-type air conditioner (10), there are many cases where each indoor unit (12) has a different heating load from the other, when each indoor unit (12) is performing a respective cooling operation. This gives rise to the possibility that there occurs an excessive drop in evaporative temperature in the indoor heat exchanger (53) of a certain one of the indoor units (12) that has a smaller cooling load. As a result, drain water adhering to the certain one indoor heat exchanger (53) may turn to ice. When such drain water is frozen to ice, an ice melting operation for melting the ice is started.

In the following, description will be made regarding the operation of the air conditioner (10) during the ice melting operation. In the air conditioner (10), the ice melting operation is executable for each of the indoor heat exchangers (53) of the indoor units (12). As described above, control of the ice melting operation is performed by the ice melting operation control part (81) of the controller (80). In the ice melting operation control part (81), control of the ice melting operation is performed for each of the indoor heat exchangers (53). In other words, even when an ice melting operation is being executed in the indoor heat exchanger (53) of a certain one of the indoor units (12), a cooling operation can be performed by the indoor heat exchanger (53) of another indoor unit (12), regardless of the ice melting operation. Of course, three are cases where ice melting operations are performed at the same time in a plurality of indoor units (12, . . . ).

When the ice melting operation control part (81) determines start of the ice melting operation with respect to a certain indoor heat exchanger (for example, the indoor heat exchanger (53*a*)), it places the expansion valve (52*a*) (which adjusts the flow rate of refrigerant of the indoor heat exchanger (53)) in the closed state. In this state, the indoor fan (57*a*) remains driven in succession to the cooling operation. Consequently, the ice melting operation is executed and ice adhering to the indoor heat exchanger (53*a*) is melted by room air fed thereinto by the indoor fan (57*a*).

When the ice melting operation control part (81) determines termination of the ice melting operation, it places the expansion valve (52*a*) in the open state, with the indoor fan (57*a*) remaining driven. This allows refrigerant to flow into the indoor heat exchanger (53*a*) and the cooling operation is resumed.

Operation of the Ice Melting Operation Control Part

In the following, description will be made regarding the operation of the ice melting operation control part (81) of the controller (80). As described above, the ice melting operation control part (81) performs ice melting operation control on each indoor heat exchanger (53). In the following, ice melting operation control with respect to a certain one of the three indoor heat exchangers (53*a*, 53*b*, 53*c*), e.g., the indoor heat exchanger (53*a*), will be described. Although description is omitted, the ice melting operation control part (81) performs ice melting operation control on the other indoor heat exchangers (53*b*, 53*c*) in the same way as performed on the indoor heat exchanger (53*a*).

Figure 2:
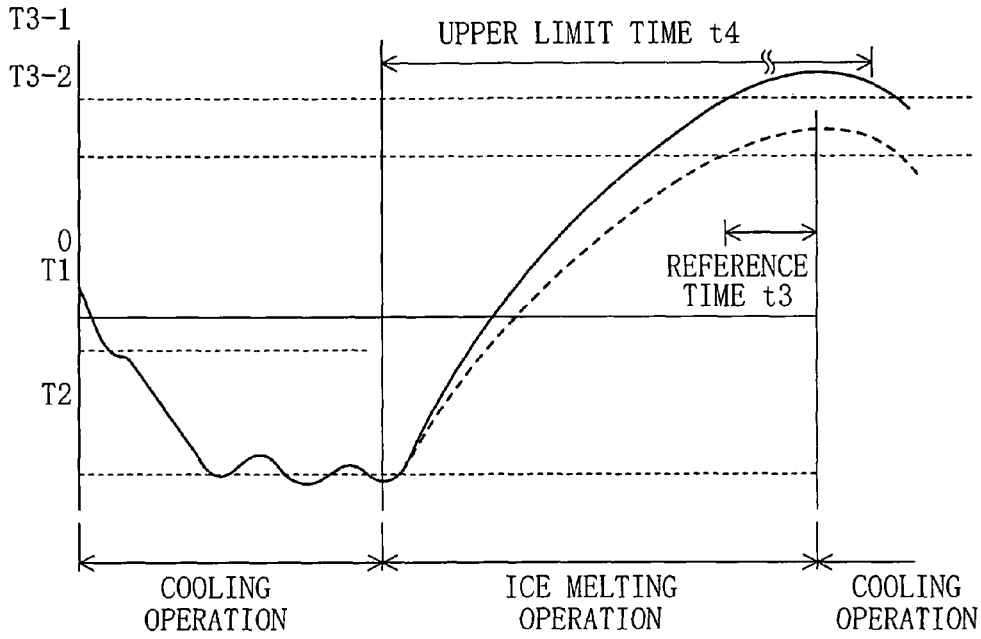
FIG. 2 is a graphical diagram representing variation with time in the value of measurement taken by a first temperature sensor (54) of the first embodiment.

Once a predetermined start condition is met, the ice melting operation control part (81) provides control so that an ice melting operation is started. On the other hand, once a predetermined termination condition is met, the ice melting operation control part (81) provides control so that the ice melting operation is terminated. In the first place, description will be made regarding the operation of the ice melting operation control part (81) until the time when the ice melting operation is started. FIG. 2 is a graphical diagram representing variation with time in the value of measurement taken by the first temperature sensor (54*a*) from the time when a cooling operation is shifted to an ice melting operation up to the time when the ice melting operation returns to the cooling operation. Variation in the temperature of a refrigerant pipe line provided with the first temperature sensor (54*a*) when there is no refrigerant leakage in the expansion valve (52*a*) (i.e., when refrigerant passage/flow is cut off completely by placing the expansion valve (52*a*) in the closed state) is represented by solid line in FIG. 2 indicative of temperature variation during the ice melting operation.

As described above, in the air conditioner (10), there may be an excessive drop in evaporative temperature in the indoor heat exchanger (53*a*) of the indoor unit (12*a*) having a smaller cooling load when each indoor unit (12) is being in a respective cooling mode of operation. In this case, if the cooling operation is continued, the value of measurement taken by the first temperature sensor (54*a*) gradually falls as indicated by solid line in FIG. 2 during the cooling operation.

If the value of measurement taken by the first temperature sensor (54*a*) falls below a first start determination temperature (T1), the ice melting operation control part (81) starts performing accumulation of time periods during which the value of measurement taken by the first temperature sensor (54*a*) falls below the first start determination temperature (T1). In addition, if the value of measurement taken by the first temperature sensor (54*a*) decreases to a further extent to fall below a second start determination temperature (T2), the ice melting operation control part (81) starts performing accumulation of time periods during which the value of measurement taken by the first temperature sensor (54*a*) falls below the second start determination temperature (T2).

If either (a) a first condition (under which the value of accumulation of time periods during which the value of measurement taken by the first temperature sensor (54*a*) falls below the first start determination temperature (T1) reaches a first start determination time (t1)) or (b) a second condition (under which the value of accumulation of time periods during which the value of measurement taken by the first temperature sensor (54*a*) falls below the second start determination temperature (T2) reaches a second start determination time (t2)) is met, the ice melting operation control part (81) stops the cooling operation and causes an ice melting operation to start.

Subsequently, description will be made regarding the operation of the ice melting operation control part (81) up to the time when the ice melting operation is terminated. Once the ice melting operation control part (81) determines start of the ice melting operation, it places the expansion valve (52*a*) in the closed state and provides control to cause the indoor fan (57*a*) to remain driven in succession to the cooling operation.

The ice melting operation control part (81) is configured such that, if the value of measurement taken by the first temperature sensor (54*a*) continuously remains equal to or above the reference temperature (T3) for the reference time (t3), it causes the ice melting operation to be terminated. The reference temperature (T3) and the reference time (t3) will be described hereinafter.

Even if the expansion valve (52) is placed in the closed state, this does not mean that the valve element is in close contact with the valve seat, in other words, there are cases where refrigerant flow and passage cannot completely be cut off. In addition, there may be the possibility that the amount of refrigerant leakage increases gradually due to its degradation with time. In the event of refrigerant leakage from the expansion valve (52*a*), this will cause the refrigerant pipe line provided with the first temperature sensor (54*a*) to be cooled by refrigerant which has passed through the expansion valve (52*a*). As a result, as indicated by broken line in FIG. 2, the value of measurement taken by the first temperature sensor (54*a*) does not increase to the same degree as when no refrigerant leakage occurs. As a result, the value of measurement taken by the first temperature sensor (54*a*) will not increase up to a threshold temperature which is used to determine termination of the ice melting operation, and there is the possibility that, even though adhered ice has been melted, the ice melting operation will be continued. Accordingly, in the ice melting operation control part (81) of the air conditioner (10), the reference temperature (T3) is set to a value corresponding to the degree of refrigerant leakage in the expansion valve (52). The thus set reference temperature (T3) is corrected using a correction value corresponding to the degree of degradation of the expansion valve (52). Its details are described in the following.

Once an ice melting operation is started, the ice melting operation control part (81) sets the reference temperature (T3). More specifically, based on a difference between the value of measurement taken by the suction pressure sensor (93) and the value of measurement taken by the discharge pressure sensor (97), the ice melting operation control part (81) estimates that as the difference between the measured values by the pressure sensors (93, 97) increases the amount of refrigerant leakage from the expansion valve (52*a*) increases, thereby setting the reference temperature (T3) to a lower temperature. For example, if the difference between the measured values by the pressure sensors (93, 97) is equal to or above 1.0 MPa but below 1.5 MPa, the reference temperature (T3) is set to a temperature of X1 degrees Centigrade. If the measured value difference is equal to or above 1.5 MPa but below 2.0 MPa, the reference temperature (T3) is set to a temperature of X2 degrees Centigrade. If the measured value difference is equal to or above 2.0 MPa, the reference temperature (T3) is set to a temperature of X3 degrees Centigrade. In this case, X1>X2>X3.

In addition to the above, based on a difference between the value of measurement taken by the first temperature sensor (54*a*) and the value of measurement taken by the room temperature sensor (56*a*) during suspension of the cooling operation, the ice melting operation control part (81) decides a correction value. This measured value difference is prestored in the ice melting operation control part (81). Then, the reference temperature (T3) set based on the difference between the measured values by the pressure sensors (93, 97) is subtracted from the correction value to thereby correct the reference temperature (T3). The ice melting operation control part (81) estimates such that as the difference between the measured values by the temperature sensors (54*a*, 56*a*) increases the degree of degradation of the expansion valve (52*a*) increases, and sets the correction value to a greater value. For example, if the difference between the measured values by the temperature sensors (54*a*, 56*a*) is below 10 degrees Centigrade during suspension of the cooling operation, the ice melting operation control part (81) estimates such that the expansion valve (52*a*) little deteriorates, and decides the correction value to be a temperature of Y1 degrees Centigrade. If the measured value difference is equal to or above 10 degrees Centigrade but below 15 degrees Centigrade, the correction value is decided to be a temperature of Y2 degrees Centigrade. If the measured value difference is equal to or above 15 degrees Centigrade but below 20 degrees Centigrade, the correction value is decided to be a temperature of Y3 degrees Centigrade. In this case, Y3>Y2>Y1.

In the ice melting operation control part (81), the reference temperature (T3) corrected is used as a threshold for determining termination of the ice melting operation. Referring to FIG. 2, there are shown a reference temperature (T3-1) and a reference temperature (T3-2) the former of which represents a reference temperature corresponding to the case where it is estimated that little refrigerant leakage occurs in the expansion valve (52*a*) and the latter of which represents a reference temperature corresponding to the case where it is estimated that some degree of refrigerant leakage occurs in the expansion valve (52*a*).

Subsequently, the ice melting operation control part (81) sets a reference time (t3) for determining termination of the ice melting operation. More specifically, based on a difference between the value of measurement taken by the first temperature sensor (54*a*) and the value of measurement taken by the room temperature sensor (56*a*) immediately before the time when the ice melting operation is about to start, the ice melting operation control part (81) sets the reference time (t3). As these measured values by the first temperature sensor (54*a*) and the room temperature sensor (56*a*), measured values after start of the ice melting operation may be used. The ice melting operation control part (81) estimates such that, as the difference between the measured values by the temperature sensors (54*a*, 56*a*) increases, adhered ice requires less time to be melted, and sets the reference time (t3) to a smaller value. For example, if the difference between the measured values by the temperature sensors (54*a*, 56*a*) immediately before the time when the ice melting operation is about to start is equal to or above 10 degrees Centigrade but below 15 degrees Centigrade, the reference time (t3) is set to a time of Z1 minutes. If the measured value difference is equal to or above 15 degrees Centigrade but below 20 degrees Centigrade, the reference time (t3) is set to a time of Z2 minutes. If the measured value difference is equal to or above 20 degrees Centigrade, the reference time (t3) is set to a time of Z3 minutes. In this case, Z1>Z2>Z3.

Subsequently, the ice melting operation control part (81) sets an upper limit time (t4) for determining forceful termination of the ice melting operation. More specifically, based on a difference between the value of measurement taken by the first temperature sensor (54*a*) and the value of measurement taken by the room temperature sensor (56*a*) immediately before the time when the ice melting operation is about to start, the ice melting operation control part (81) sets the upper limit time (t4). As these measured values by the first temperature sensor (54*a*) and the room temperature sensor (56*a*), measured values after start of the ice melting operation may be used. The ice melting operation control part (81) estimates such that, as the difference between the measured values by the temperature sensors (54*a*, 56*a*) increases, adhered requires less time to be melted, thereby setting the upper limit time (t4) to a smaller value. For example, if the difference between the measured values by the temperature sensors (54*a*, 56*a*) immediately before the time when the ice melting operation is about to start is equal to or above 10 degrees Centigrade but below 15 degrees Centigrade, the upper limit time (t4) is set to a time of W1 minutes. If the measured value difference is equal to or above 15 degrees Centigrade but below 20 degrees Centigrade, the upper limit time (t4) is set to a time of W2 minutes. If the measured value difference is equal to or above 20 degrees Centigrade, the upper limit time (t4) is set to a time of W3 minutes. In this case, W1>W2>W3.

In the way as described above, the reference temperature (T3) is set and then corrected, and the reference temperature (T3) and the upper limit time (t4) are set. Based on these values, the ice melting operation control part (81) determines termination of the ice melting operation. More specifically, once the ice melting operation is started, ice adhering to the indoor heat exchanger (53*a*) is heated by indoor air fed in by the indoor fan (57*a*) and starts gradually melting. Since the refrigerant pipe line disposed in the first temperature sensor (54*a*) is also heated by air fed in by the indoor fan (57*a*), the value of measurement taken by the first temperature sensor (54*a*) gradually increases as indicated by solid line in FIG. 2. When the value of measurement taken by the first temperature sensor (54*a*) exceeds the reference temperature (T3), the ice melting operation control part (81) starts performing accumulation of time periods during which the measured value by the first temperature sensor (54*a*) exceeds the reference temperature (T3). Once the value of accumulation of time periods during which the value of measurement taken by the first temperature sensor (54*a*) exceeds the reference temperature (T3) reaches the reference time (t3), the ice melting operation control part (81) brings the ice melting operation to a halt and causes start of a cooling operation. In addition, even when the value of accumulation of time periods during which the value of measurement taken by the first temperature sensor (54*a*) exceeds the reference temperature (T3) does not reach the reference time (t3), the ice melting operation control part (81) forcefully brings the ice meting operation to a halt when the duration time of the ice melting operation reaches the upper limit time (t4).

Advantageous Effects of the First Embodiment

It is configured in the first embodiment such that the degree of refrigerant leakage in the expansion valve (52) is estimated from the measured values by the suction and discharge pressure sensors (93, 97). Therefore, based on the measured values by the suction and discharge pressure sensors (93, 97), the ice melting operation control parts (81) sets the reference temperature (T3) (which serves as a threshold for determining termination of the ice melting operation) to a value corresponding to the degree of refrigerant leakage in the expansion valve (52). In the past, the reference temperature (T3) has been decided without taking into consideration the leakage of refrigerant in the expansion valve (52). In the present invention, however, the reference temperature (T3) is set to a value corresponding to the degree of refrigerant leakage in the expansion valve (52), whereby, even in the event of occurrence of refrigerant leakage from the expansion valve (52), it is possible to determine termination of the ice melting operation at the reference temperature (T3) corresponding to the refrigerant leakage. Accordingly, it becomes possible to accurately determine termination of the ice melting operation, regardless of the presence or absence of refrigerant leakage in the expansion valve (52). This therefore makes it possible to prevent the ice melting operation from being unnecessarily executed while also preventing some ice from remaining unmelted.

Additionally, it is configured in the first embodiment such that an estimate of the degree of degradation of the expansion valve (52) is derived from a difference between the value of measurement taken by the first temperature sensor (54*a*) and the value of measurement taken by the room temperature sensor (56*a*) during suspension of the cooling operation. Therefore, the ice melting operation control part (81) corrects, by use of a correction value corresponding to the degree of degradation of the expansion valve (52), the reference temperature (T3) set based on the measured values by the suction and discharge pressure sensors (93, 97). The degree of degradation of the expansion valve (52) has an effect on the degree of refrigerant leakage in the expansion valve (52) during the ice melting operation, like when the cooling operation is under suspension. The first embodiment uses a correction value corresponding to the degree of degradation of the expansion valve (52) to correct the reference temperature (T3), and the reference temperature (T3) comes to have a value that reflects the degree of degradation of the expansion valve (52). Accordingly, it becomes possible to more accurately determine termination of the ice melting operation.

In addition, it is configured in the first embodiment such that an estimate of the degree of meltability of ice adhering to the indoor heat exchanger (53) is derived from a difference between the value of measurement taken by the temperature sensor (54) and the value of measurement taken by the room temperature sensor (56). Therefore, based on the measured value difference, the ice melting operation control part (81) sets the reference time (t3) to a value corresponding to the estimated degree of meltability. In the past, the ice melting operation has been brought to a halt according to the fixed reference time (t3), regardless of the degree of meltability of the adhered ice. In the first embodiment, however, the reference time (t3) is set to a value corresponding to the degree of meltability of the adhered ice, because the time required for melting of the adhered ice varies depending on the degree of meltability of the adhered ice. This therefore makes it possible to more accurately determine termination of the ice melting operation.

In addition, it is configured in the first embodiment such that an estimate of the degree of meltability of ice adhering to the indoor heat exchanger (53) is derived from a difference between the value of measurement taken by the first temperature sensor (54) and the value of measurement taken by the room temperature sensor (56). Therefore, based on the measured value difference, the ice melting operation control part (81) sets the upper limit time (t4) to a value corresponding to the estimated degree of meltability. The ice melting operation control part (81) determines termination of the ice melting operation, not only from the condition that the value of measurement taken by the first temperature sensor (54) continuously remains equal to or above the reference temperature (T3) for the reference time (t3) but also from the upper limit time (t4) which is set to a value corresponding to the estimated degree of meltability. This therefore makes it possible to more accurately determine termination of the ice melting operation.

In addition, it is configured in the first embodiment such that the ice melting operation control part (81) individually performs ice melting operation control on each of the plural indoor heat exchangers (53) disposed in the refrigerant circuit (20), and that, when the ice melting operation control part (81) decides execution of an ice melting operation on a certain one of the plural indoor heat exchangers (53), only the certain one indoor heat exchanger (53) is subjected to the ice melting operation. In other words, even when an ice melting operation is being executed in a certain one of the plural indoor heat exchangers (53), it is possible to perform a normal cooling operation in another indoor heat exchanger (53). Accordingly, in the air conditioner (10) of the first embodiment, the indoor spaces in which the indoor heat exchangers (53) are disposed respectively are properly cooled.

Variation of the First Embodiment

In the following, description will be made regarding a variation of the first embodiment. In this variation, based on a difference between the value of measurement taken by the first temperature sensor (54) and the value of measurement taken by the room temperature sensor (56), the ice melting operation control part (81) sets the reference temperature (T3). Unlike the first embodiment, the reference temperature (T3) set is not subjected to correction. One of the three indoor heat exchangers (53*a*, 53*b*, 53*c*), i.e., the indoor heat exchanger (53*a*), is selected here for the purpose of the following description.

Description will be made regarding the setting of the reference temperature (T3) in the ice melting operation control part (81). Once the ice melting operation is started, based on a difference between the value of measurement taken by the first temperature sensor (54*a*) and the value of measurement taken by the room temperature sensor (56*a*), the ice melting operation control part (81) sets the reference temperature (T3). This measured value difference is prestored in the ice melting operation control part (81). The ice melting operation control part (81) estimates such that a greater difference between the measured values by the temperature sensors (54*a*, 56*a*) indicates greater degradation of the expansion valve (52*a*), and sets the reference temperature (T3) to a lower value. For example, if the difference between the measured values by the temperature sensors (54*a*, 56*a*) is less than 10 degrees Centigrade, the ice melting operation control part (81) estimates such that the expansion valve (52*a*) little degrades and therefore sets the reference temperature (T3) to a temperature of V1 degrees Centigrade. If the measured value difference is equal to or above 10 degrees Centigrade but below 15 degrees Centigrade, the reference temperature (T3) is set to a temperature of V2 degrees Centigrade. If the measured value difference is equal to or above 15 degrees Centigrade but below 20 degrees Centigrade, the reference temperature (T3) is set to a temperature of V3 degrees Centigrade. In this case, V1>V2>V3.

In accordance with the above variation, the reference temperature (T3) comes to have a value that reflects the degree of degradation of the expansion valve (52). Accordingly, even when the expansion valve (52) degrades to undergo refrigerant leakage, the ice melting operation control part (81) determines termination of the ice melting operation at the reference temperature (T3) corresponding to that valve degradation, thereby making it possible to more accurately determine termination of the ice melting operation. Consequently, it becomes possible to prevent the ice melting operation from being unnecessarily executed while also preventing some ice from remaining unmelted.

Second Embodiment of the Invention

Figure 3:
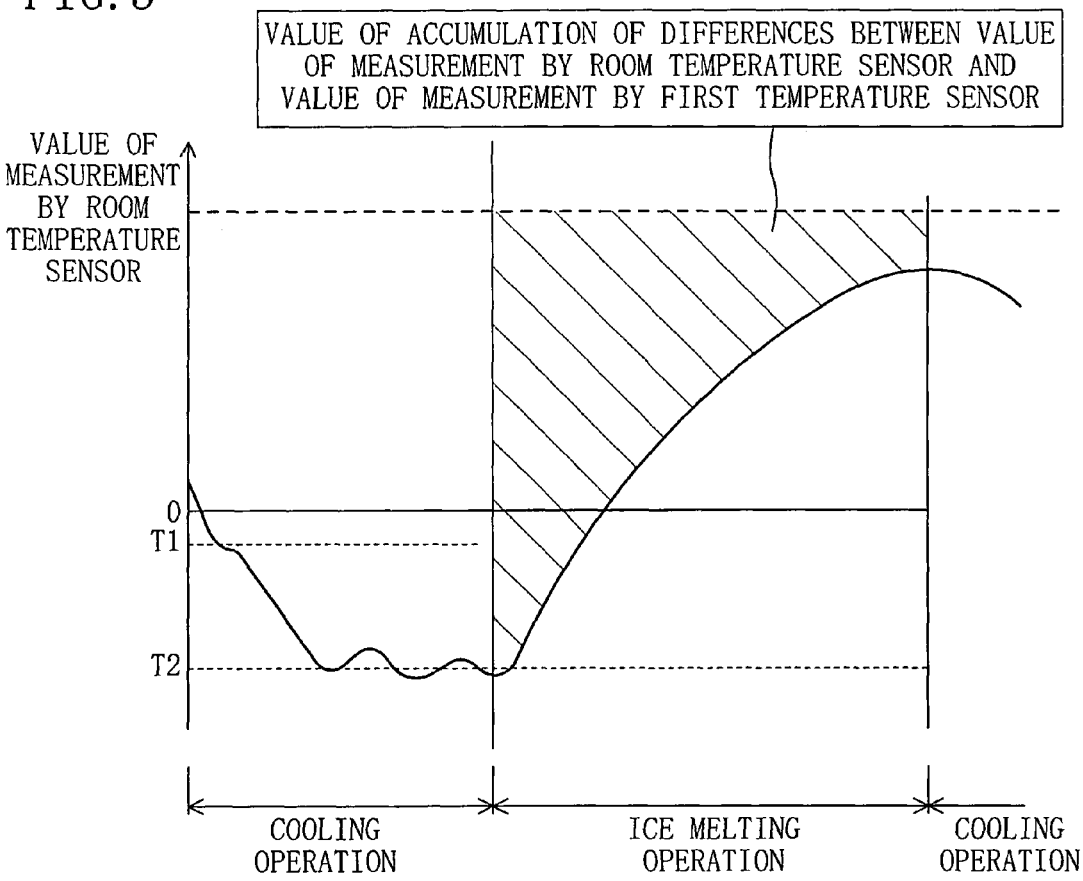
FIG. 3 is a graphical diagram representing variation with time in the value of measurement taken by a first temperature sensor (54) of a second embodiment of the present invention.

In the following, description will be made regarding a second embodiment of the present invention. In the first embodiment, the ice melting operation control part (81) determines, based on the reference temperature (T3) and the reference time (t3), termination of the ice melting operation. Unlike the first embodiment, the ice melting operation control part (81) of the second embodiment determines termination of the ice melting operation, based on the value of accumulation of differences between the value of measurement taken by the first temperature sensor (54) and the value of measurement taken by the room temperature sensor (56) since the time that the ice melting operation was started. One of the three indoor heat exchangers (53*a*, 53*b*, 53*c*), i.e., the indoor heat exchanger (53*a*), is selected here for the purpose of the following description. FIG. 3 is a graphical diagram representing variation with time in the value of measurement taken by the first temperature sensor (54*a*) from the time when a cooling operation is shifted to an ice melting operation up to the time when the ice melting operation returns to the cooling operation.

In the following, description will be made regarding the operation of the ice melting operation control part (81) during the time from when the ice melting operation is started to when the ice melting operation is terminated. A setting value used to determine termination of the ice melting operation is prestored in the ice melting operation control part (81). The setting value is so set as to have a value corresponding to the amount of ice adhering to the indoor heat exchanger (53*a*) at the time when the ice melting operation is started.

Once the ice melting operation is started, the ice melting operation control part (81) calculates the value of accumulation of differences between the value of measurement taken by the first temperature sensor (54*a*) and the value of measurement taken by the room temperature sensor (56*a*), for example, for every 10 seconds (this accumulation value is represented by a hatched portion in FIG. 3). If the accumulation value exceeds the preset setting value, the ice melting operation control part (81) brings the ice melting operation to a halt.

Advantageous Effects of the Second Embodiment

In the second embodiment, there is made an estimate of the amount of heat exchanged between air fed into the indoor heat exchanger (53*a*) during execution of the ice melting operation and ice adhering to the indoor heat exchanger (53*a*), and the value of accumulation of differences between the value of measurement taken by the first temperature sensor (54) and the value of measurement taken by the room temperature sensor (56) during the ice melting operation is used to determine termination of the ice melting operation. The amount of exchanged heat estimated from the accumulation value corresponds to the amount of melted ice. Therefore, it is possible to estimate, based on the accumulation value, whether or not a predetermined amount of ice has been melted, thereby making it possible to accurately determine termination of the ice melting operation. In addition, in the second embodiment, even in the case where there is leakage of refrigerant, the increase in the value of accumulation of differences between the measured values by the temperature sensors (54, 56) will not be impeded. This therefore eliminates the problem associated with the conventional technology that the air conditioner fails to return to its normal cooling operation from the ice melting operation due to refrigerant leakage in the expansion valve (52). Consequently, it becomes possible to prevent the ice melting operation from being unnecessarily executed while also preventing some ice from remaining unmelted.

Third Embodiment of the Invention

In the following, description will be made regarding a third embodiment of the present invention. In the third embodiment, the ice melting operation control part (81) sets an operating time (t5) from start to termination of the ice melting operation, and brings the ice melting operation to a halt when the duration time of the ice melting operation reaches the operating time (t5). One of the three indoor heat exchangers (53*a*, 53*b*, 53*c*), i.e., the indoor heat exchanger (53*a*), is selected her for the purpose of the following description.

Description will be made regarding the operation of the ice melting operation control part (81) up to the time when the ice melting operation started is terminated. Once the ice melting operation starts, the ice melting operation control part (81) of the third embodiment sets the operating time (t5) of the ice melting operation. More specifically, based on a difference between the value of measurement taken by the first temperature sensor (54*a*) and the value of measurement taken by the room temperature sensor (56*a*) immediately before the time when the ice melting operation is about to start, the ice melting operation control part (81) sets the operating time (t5). As these measured values by the first temperature sensor (54*a*) and the room temperature sensor (56*a*), measured values after start of the ice melting operation may be used. The ice melting operation control part (81) estimates such that, as the difference between the measured values by the temperature sensors (54*a*, 56*a*) increases, adhered ice requires less time to be melted, and sets the operating time (t5) to a smaller value. For example, if the difference between the measured values by the temperature sensors (54*a*, 56*a*) immediately before the time when the ice melting operation is about to start is equal to or above 10 degrees Centigrade but below 15 degrees Centigrade, the operating time (t5) is set to a time of S1 minutes. If the measured value difference is equal to or above 15 degrees Centigrade but below 20 degrees Centigrade, the operating time (t5) is set to a time of S2 minutes. If the measured value difference is equal to or above 20 degrees Centigrade, the operating time (t5) is set to a time of S3 minutes. In this case, S1>S2>S3.

When the duration time of the ice melting operation reaches the operating time (t5), the ice melting operation control part (81) brings the ice melting operation to a halt.

Advantageous Effects of the Third Embodiment

In the third embodiment, the degree of meltability of ice adhering to the indoor heat exchanger (53) is estimated from a difference between the value of measurement taken by the first temperature sensor (54*a*) and the value of measurement taken by the room temperature sensor (56*a*). The ice melting operation control part (81) sets, based on the measured value difference, the operating time (t5) from start to termination of the ice melting operation to a value corresponding to the estimated degree of meltability. The time required to melt the adhered ice varies depending on the degree of meltability thereof. In the third embodiment, the operating time (t5) is set to a value corresponding to the degree of meltability of the adhered ice, thereby making it possible to more accurately determine termination of the ice melting operation. Even in the event of refrigerant leakage from the expansion valve (52), the setting of the operating time (t5) is little affected by that refrigerant leakage, therefore eliminating the problem associated with the conventional technology that the air conditioner fails to return to its normal cooling operation from the ice melting operation due to refrigerant leakage in the expansion valve (52). Consequently, it becomes possible to prevent the ice melting operation from being unnecessarily executed while also preventing some ice from remaining unmelted.

It should be noted that the above-descried embodiments are essentially preferable examples which are not intended in any sense to limit the scope of the present invention, its application, or its application range.

INDUSTRIAL APPLICABILITY

As has been described above, the present invention finds its utility in the field of air conditioners configured to perform an ice melting operation on a utilization-side heat exchanger with ice adhering thereto.

What is claimed is:

1. An air conditioner comprising a refrigerant circuit (20) wherein the refrigerant circuit (20) includes: a compressor (41); a utilization-side heat exchanger (53); and an expansion valve (52) for controlling the amount of refrigerant flowing into the utilization-side heat exchanger (53), to thereby perform a refrigeration cycle, and wherein the air conditioner performs a cooling operation for room cooling while during the cooling operation the air conditioner is able to execute an ice melting operation for melting of ice adhering to the utilization-side heat exchanger (53) by closing the expansion valve (52) to thereby feed air to the utilization-side heat exchanger (53), the air conditioner comprising:

high-low pressure difference detection means (93, 97) for detecting a difference between a high and a low pressure of the refrigeration cycle;

temperature measurement means (54) for measuring either the temperature of a pipe line between the expansion valve (52) and the utilization-side heat exchanger (53) or the temperature of the utilization-side heat exchanger (53); and control means (81) for activating the ice melting operation to start if a predetermined start condition is met and for terminating the ice melting operation if the value of measurement taken by the temperature measurement means (54) continuously remains equal to or above a reference temperature (T3) for a reference time (t3);

wherein, based on the value of measurement taken by the high-low pressure difference detection means (93, 97), the control means (81) sets the reference temperature (T3).

2. The air conditioner of claim 1, wherein the air conditioner further comprises room temperature measurement means (56) for measuring room temperature; and wherein the control means (81) decides, based on a difference between the value of measurement taken by the temperature measurement means (54) and the value of measurement taken by the room temperature measurement means (56) during suspension of the cooling operation, a correction value, and corrects, by use of the correction value, the reference temperature (T3) set based on the value of measurement taken by the high-low pressure difference detection means (93, 97).

3. The air conditioner of any one of claims 1 and 2, wherein, based on a difference between the value of measurement taken by the temperature measurement means (54) and the value of measurement taken by the room temperature measurement means (56), the control means (81) sets the reference time (t3).

4. The air conditioner of claim 1, wherein the control means (81) terminates the ice meting operation if the duration time of the ice melting operation reaches a predetermined upper limit time (t4) and sets, based on a difference between the value of measurement taken by the temperature measurement means (54) and a value of measurement taken by a room temperature measurement means (56), the upper limit time (t4).

5. The air conditioner of claim 1, wherein the refrigerant circuit (20) includes a plurality of the utilization-side heat exchangers (53) and a plurality of the expansion valves (52) each of which controls the amount of refrigerant flowing into its associated utilization-side heat exchanger (53);

wherein the ice melting operation is executable for each of the utilization-side heat exchangers (53); and wherein the control means (81) controls start and termination of the ice melting operation for each of the utilization-side heat exchangers (53).

* * * * *